US011584031B2

(12) United States Patent
Martin

(10) Patent No.: US 11,584,031 B2
(45) Date of Patent: Feb. 21, 2023

(54) PACKAGE OPENING DEVICE

(71) Applicant: Karen Carter Martin, Fredericksburg, TX (US)

(72) Inventor: Karen Carter Martin, Fredericksburg, TX (US)

( * ) Notice: Subject to any disclaimer, the term of this patent is extended or adjusted under 35 U.S.C. 154(b) by 0 days.

(21) Appl. No.: 16/845,232

(22) Filed: Apr. 10, 2020

(65) Prior Publication Data

US 2021/0316467 A1 Oct. 14, 2021

(51) Int. Cl.
*B26B 27/00* (2006.01)
*B65B 69/00* (2006.01)

(52) U.S. Cl.
CPC ..... *B26B 27/005* (2013.01); *B65B 69/0033* (2013.01)

(58) Field of Classification Search
CPC .. B26B 27/005; B65B 69/003; B65B 69/0041
See application file for complete search history.

(56) References Cited

U.S. PATENT DOCUMENTS 394,547 A * 12/1888 Thacker ..... B25F 1/00 7/166
2,238,753 A * 4/1941 Robie ..... B26B 27/005 30/2
4,167,810 A * 9/1979 Gilbert ..... B26B 27/005 30/2
6,314,644 B1 * 11/2001 Raeker ..... B26B 27/005 30/2
6,598,303 B2 * 7/2003 Bosy ..... B26B 21/52 30/526
7,296,353 B1 * 11/2007 Jackson ..... B26B 27/005 30/171
7,464,470 B2 * 12/2008 Grosh ..... B26B 1/08 30/2
9,114,543 B2 * 8/2015 Votolato ..... B26B 27/005

* cited by examiner

*Primary Examiner* — Omar Flores Sanchez
(74) *Attorney, Agent, or Firm* — Brian K. Yost; Decker Jones, PC

(57) ABSTRACT

The package opening device generally comprises a body portion, neck portion, and cutting member. In a preferred embodiment, the body portion comprises an elongated ovular configuration. The body portion comprises an upper surface and a lower surface. Adjacent to a distal end of the body portion is a through opening penetrating the upper and lower surfaces. Adjacent to a proximal end of the body portion, the upper surface comprises a recessed area. The neck portion extends from the proximal end of the body portion. Extending downward from a neck portion proximal end is the cutting member. The cutting member comprises a tapered tip.

10 Claims, 2 Drawing Sheets

PACKAGE OPENING DEVICE

BACKGROUND OF THE INVENTION

1. Field of the Invention

The present invention relates generally to hand tools and specifically to a package opening device adapted for use in opening packages such as blister packs and other sealed containers.

2. Description of the Prior Art

Blister packs are commonly used to package food items, pharmaceuticals, toys, and a variety of other consumer goods. A conventional blister pack comprises an outer shell with a backing of paper or aluminum. Between the outer shell and backing is a cavity within which a product may be inserted. The outer shell of many conventional blister packs is from polyvinylchloride (PVC). Such outer shells are often transparent. A transparent outer shell permits the user to see the contents positioned within the cavity.

The outer shell may be formed in a variety of different manners. Generally, outer shells are formed through thermoforming, cold forming, or a combination of the two. With the thermoforming process, a plastic film is heated and formed into a desired shape, under pressure. With conventional cold forming an aluminum-based film is pressed over a mold into the desired shape or configuration. After the plastic shell is formed, the product is inserted within the cavity. The backing is then affixed to the shell portion, thus, sealing the product within the cavity.

Other containers such as pain reliever bottles and peanut butter jars, and the like have an upper opening which is factory sealed with a protective film barrier. In such configurations, the product is largely protected from moisture, contamination, and tampering.

Unfortunately, the same properties that protect the product often also make blister packs and other sealed containers difficult to open. Users often attempt to tear open the package or use sharp and dangerous instruments unsuited for the task. For example, consumers often attempt to open sealed containers using knives, forks, scissors, or other sharp objects. Thousands of people each year are injured while attempting to open packaging. This problem is compounded when a person is required to open numerous sealed containers each day. For example, nurses and other health care providers are often called upon to open blister packs containing pharmaceuticals. Because there are numerous pharmaceuticals that are packaged in blister packs or sealed containers and a healthcare provider may have numerous patients requiring such medicine, the provider may be called on to open dozens of blister packs and sealed containers every day. Without a safe and effective tool to do this, the safety of healthcare providers and other consumers is at great risk.

What is needed is a package opening device that permits a user to easily and safely open blister pack and other sealed containers and packaging.

SUMMARY OF THE INVENTION

The package opening device generally comprises a body portion, neck portion, and cutting member. In a preferred embodiment, the body portion comprises an elongated ovular configuration. The body portion comprises an upper surface and a lower surface. Adjacent to a distal end of the body portion is a through opening penetrating the upper and lower surfaces. Adjacent to a proximal end of the body portion, the upper surface comprises a recessed area. The neck portion extends from the proximal end of the body portion. Extending downward from a neck portion proximal end is the cutting member. The cutting member comprises a tapered tip.

In one embodiment, the neck portion extends outward on a generally parallel path from the body portion. In this embodiment, the cutting member extends downward from the neck portion at a right angle.

In another embodiment of the package opening device the neck portion extends at an upward angle from the body portion. In this embodiment, the upward angle is preferably 45 degrees from the planar portion of the upper surface, in this embodiment, the cutting member extends downward at a right angle in relation to the neck portion.

The neck portion may comprise other relative angles in relation to the planar portion of the upper surface. The angle can be greater than 45 degrees. The angle can be downward such that the neck extends at a downward angle of between zero and over 90 degrees in relation to the planar portion of the upper surface.

The cutting member is adapted to penetrate conventional packaging while being short enough so as not to present an unreasonable danger to the user. The recessed portion comprises a circular outside configuration which tapers downward. The recessed portion is structured and arranged to receive the user's thumb.

The package opening device of preferred embodiments is formed from polycarbonate material sufficiently strong as to permit a user to open many packages. The package opening device may be formed from any suitable material known in the art. The body portion may be formed from a polycarbonate material and the cutting member may be formed from metal. The package opening device may be formed from a unitary piece of material or may be formed from a combination of parts. For example, the cutting member may be removeably coupled to the neck portion, such as, for instance through cooperative coupling mechanisms well known in the art, including, but not limited to threaded or frictional attachments.

DESCRIPTION OF THE PREFERRED EMBODIMENT

Referring to FIGS. 1-9, there is shown the package opening device 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation.

Figure 1:
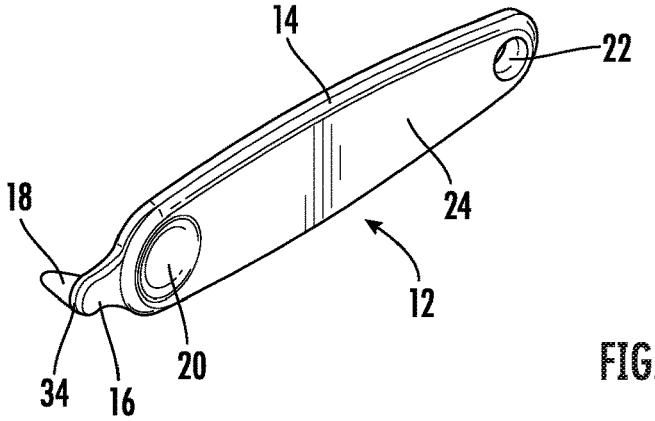
FIG. 1 is an isometric proximal end and top side view of the package opening device in accordance with a preferred embodiment.
Figure 2:
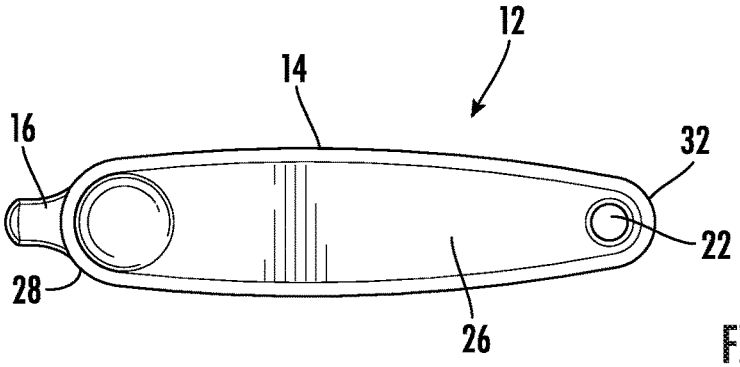
FIG. 2 is a bottom side plan view of the package opening device of FIG. 1.
Figure 3:
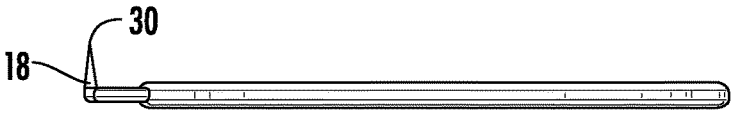
FIG. 3 is a side elevation view of the package opening device of FIG. 1.
Figure 4:
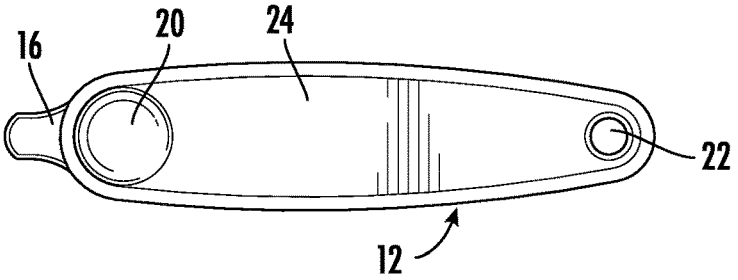
FIG. 4 is a top side elevation view of the package opening device of FIG. 1.
Figure 5:
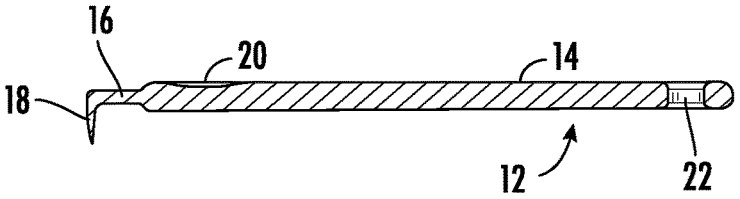
FIG. 5 is sectional view along Section A-A of FIG. 4.
Figure 6:
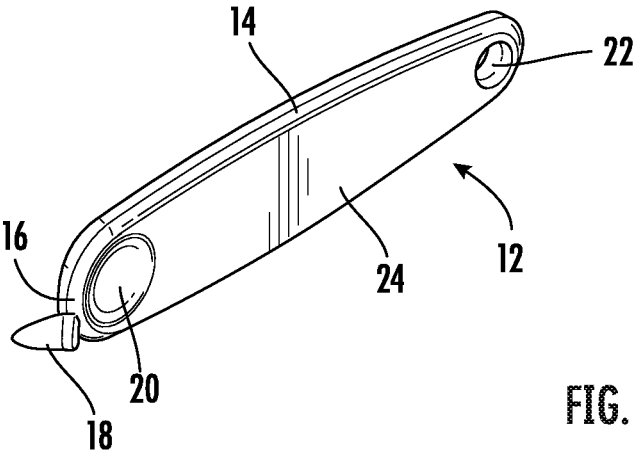
FIG. 6 is an isometric proximal end and top side view of the package opening device in accordance with another preferred embodiment.

Referring to FIGS. 1-5, the package opening device 12 of a first preferred embodiment generally comprises a body portion 14, neck portion 16, and cutting member 18. The neck portion 16 of the preferred embodiment is narrower than the body portion 14. In this preferred embodiment, the body portion 14 comprises an elongated ovular configuration when viewed from above in plan view as shown in FIG. 4. The body portion 14 comprises an upper surface 24 and a lower surface 26 and proximal and distal ends 28, 32. In the preferred embodiment, the proximal end 28 is wider than the distal end 32. The distal end 32 of the body portion 14 comprises a through opening 22 penetrating the upper and lower surfaces 24, 26. The proximal end 28 of the body portion 14 on the upper surface 24, comprises a recessed area 20. The neck portion 16 extends from the proximal end 28 of the body portion 14. Extending downward from a neck portion proximal end 34 is the cutting member 18. The cutting member comprises a tapered tip 30.

In the embodiment depicted in FIGS. 1-5, the neck portion 16 extends outward on a generally parallel path from the body portion 14. In this embodiment, the cutting member 18 extends downward from the neck portion 16 at a right angle.

Figure 7:
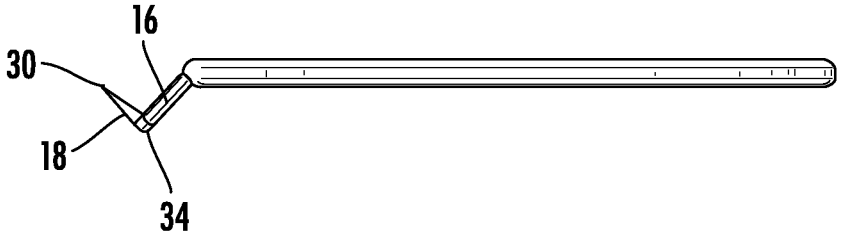
FIG. 7 is a side elevation view of the package opening device of FIG. 6.
Figure 8:
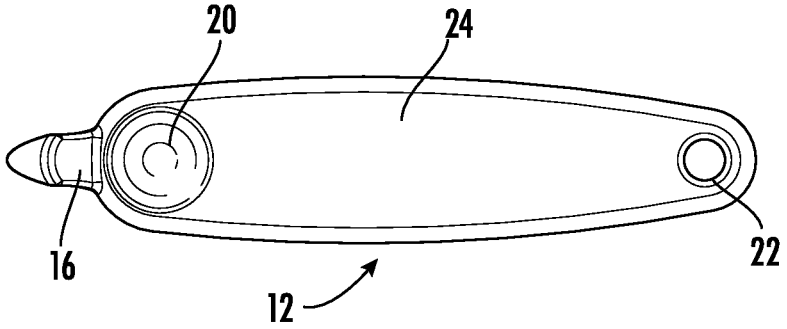
FIG. 8 is a is a top side elevation view of the package opening device of FIG. 6.
Figure 9:
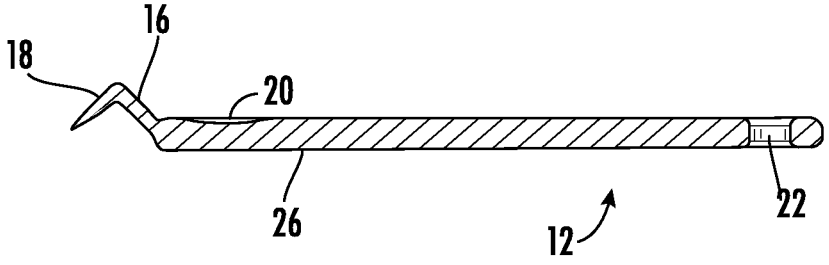
FIG. 9 is a is sectional view along Section A-A of FIG. 8.

Referring to FIGS. 6-9, a second embodiment of the package opening device 12 is shown. The package opening device 12 of the second preferred embodiment generally comprises a body portion 14, neck portion 16, and cutting member 18. In this preferred embodiment, the body portion 14 also comprises an elongated ovular configuration when viewed from above in plan view as shown in FIG. 8. The body portion 14 comprises the upper surface 24 and lower surface 26, through opening 22 and recessed area 20. The neck portion 16 of this embodiment extends at an upward angle from the body portion 14 as best shown in FIGS. 7 and 9. In this preferred embodiment, the upward angle is preferably 45 degrees from the planar portion of the upper surface 24 (the portion not comprising the recessed area 20). In this embodiment, the cutting member 18 extends downward at a right angle in relation to the neck portion 16.

Although the angle of the neck portion 16 in relation to the planar portion of the upper surface 24 is zero degrees in the embodiment in FIGS. 1-5 and 45 degrees in the embodiment in FIGS. 6-9, the neck portion 16 may comprise other relative angles in relation to the planar portion of the upper surface 24. For example, the angle can be greater than 45 degrees. By way of further example, the angle can also be downward such that the neck portion 16 extends at a downward angle of between zero and over 90 degrees in relation to the planar portion of the upper surface 24.

In the preferred embodiments described herein, the body portion 14 comprises a length of approximately 3¼ inches, a 0.80-inch width, and a 0.15-inch depth. The cutting member 18 comprises a length of approximately 0.05 inches and is, thus, adapted to penetrate conventional packaging while being short enough so as not to present an unreasonable danger to the user. The recessed portion 20 comprises a circular outside configuration which tapers downward. The recessed portion 20 is structured and arranged to receive the user's thumb. Although the preferred embodiments comprise the dimensions described herein, the package opening device 12 need not comprise such dimensions. Rather, package opening device 12 may have dimensions greater or lesser than those described in this disclosure.

The package opening device 12 of the preferred embodiments is formed from polycarbonate material is sufficiently strong as to permit a user to open many packages. Although the package opening device 12 of the preferred embodiments is formed from polycarbonate material, the package opening device 12 may be formed from any suitable material known in the art. For example, the package opening device 12 may be formed from metal, composite materials, other plastics or a combination of materials. By way of further example, the body portion 14 may be formed from a polycarbonate material and the cutting member 18 may be formed from metal. The package opening device 12 may be formed from a unitary piece of material or may be formed from a combination of parts. For example, the cutting member 18 may be removeably coupled to the neck portion 16, such as, for instance through cooperative coupling mechanisms well known in the art, including, but not limited to threaded or frictional attachments.

The use of the package opening device 12 will now be described. In use, the user preferably grasps the device 12 with a single hand with the user's thumb positioned within the recessed portion 22. While grasping the package opening device 12 in one hand, the user positions the tapered tip 30 portion of the cutting member 18 against a portion of a package the user desires to open. While applying pressure against the package with the cutting member 18, the user moves the cutting member 18 through the packaging. A forward, rearward, circular, or sideward motion may be employed in this process.

The detailed description provided herein illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

I claim:

1. A package opening device comprising:

a body portion, a neck portion, and cutting member;

the body portion having an elongated ovular configuration and comprising an upper surface, and a lower surface;

the upper surface comprising a recessed area adjacent to a proximal end of the body portion, the recessed area comprising a circular perimeter defined by a planar portion of the upper surface surrounding the recessed area;

the neck portion and body portion sharing a longitudinal center;

the neck portion being narrower than the body portion and extending from the proximal end of the body portion such that first and second shoulders are defined;

the cutting member extending downward from a proximal end of the neck portion; and wherein the cutting member comprises a tapered tip adapted to penetrate a portion of a package.

2. The package opening device of claim 1, wherein a distal end of the body portion comprises a through opening penetrating the upper and lower surfaces.

3. The package opening device of claim 1, wherein the neck portion extends outward from a proximal end of the body portion parallel to the planar portion of the upper surface.

4. The package opening device of claim 1, wherein the neck portion extends outward from a proximal end of the body portion at a downward angle relative to the planar portion of the upper surface.

5. The package opening device of claim 1, wherein the cutting member extends from the neck portion at a right angle.

6. The package opening device of claim 1, wherein the proximal end of the body portion is wider than the distal end of the body portion.

7. A package opening device comprising:

a body portion, a neck portion, and cutting member;

the body portion having an elongated ovular configuration, an upper surface, and a lower surface;

the upper surface comprising a recessed area adjacent to a proximal end of the body portion, the recessed area comprising a circular perimeter defined by a planar portion of the upper surface surrounding the recessed area;

the neck portion and body portion sharing a longitudinal center;

a distal end of the body portion comprising a through opening penetrating the upper and lower surfaces;

the proximal end of the body portion being wider than the distal end of the body portion;

the neck portion being narrower than the proximal end of the body portion, the neck portion extending from the proximal end of the body portion such that first and second shoulders are defined;

the cutting member extending downward from a proximal end of the neck portion; and wherein the cutting member comprises a tapered tip adapted to penetrate a portion of a package.

8. The package opening device of claim 7, wherein the neck portion extends outward from a proximal end of the body portion parallel to the planar portion of the upper surface.

9. The package opening device of claim 7, wherein the neck portion extends outward from a proximal end of the body portion at a downward angle relative to the planar portion of the upper surface.

10. The package opening device of claim 7, wherein the cutting member extends from the neck portion at a right angle.

* * * * *